US005780788A

United States Patent [19]

Eschenbrenner et al.

[11] Patent Number: 5,780,788

[45] Date of Patent: Jul. 14, 1998

[54] SPECIAL EMERGENCY SERVICE CONTROL ARRANGEMENT FOR ELEVATOR CAR

[75] Inventors: John Michael Eschenbrenner, Torrington; Robert James Logemann, Avon, both of Conn.

[73] Assignee: Otis Elevator Company, Farmington, Conn.

[21] Appl. No.: 808,708

[22] Filed: Feb. 28, 1997

Related U.S. Application Data

[63] Continuation of Ser. No. 644,938, May 13, 1996, abandoned, which is a continuation of Ser. No. 207,498, Mar. 7, 1994, abandoned.

[51] Int. Cl.[6] ..... B66B 13/14

[52] U.S. Cl. ..... 187/316; 187/393; 187/390

[58] Field of Search ..... 187/316, 391, 187/393, 381, 390, 248, 247

[56] References Cited

U.S. PATENT DOCUMENTS

| | | | |
|---|---|---|---|
| 3,726,364 | 4/1973 | Citrin et al. | 187/29 R |
| 3,773,145 | 11/1973 | Drexler | 187/29 R |
| 4,128,143 | 12/1978 | Petterson et al. | 187/29 R |
| 4,210,226 | 7/1980 | Ichioka | 187/29 R |
| 4,298,100 | 11/1981 | Suss et al. | 187/29 R |
| 4,326,606 | 4/1982 | Kuzunuki et al. | 187/29 R |
| 4,567,560 | 1/1986 | Polis et al. | 187/247 |

OTHER PUBLICATIONS

ASME Rules pp. 86–88, 1993.

*Primary Examiner*—Robert Nappi

[57] ABSTRACT

An electronic controller arrangement for an elevator car includes an auxiliary controller including instructions for disconnecting a main operational controller from a door operator when either a Phase I (emergency car recall operation); or a Phase II (in-car operation during emergency); special emergency service signal is detected by the auxiliary controller and for performing all door control operations during the Phase I or Phase II emergency condition.

5 Claims, 13 Drawing Sheets

PLC 100A
TB46
TB9
SS
DFO
DFO(I)
TB39
DOL
C23
DOCB
OS
C15
W/MONITOR
SG
NR
SS
W/ELECT.DET.
W/MAGNETIC SAFETY SHOE
AE
LRCU
RED
NOTE7
GREEN
C71
EPD
EPR
EP1
EP2
W/ELECT.DET.
ISGS
SGS
SGL
ISGL
C74
C160
C161
GH
W/MECHANICAL SAFETY SHOE
DO
TB69

(MAIN) OPERATIONAL CONTROLLER

INPUTS
+24VDC
TB42
RSB
TB38
HOLD
TB36
HEKB
TB32
HEK
TB31
/ALS
TB29
/MLS
TB30
HLI
TB47
RUN
CSI
DCB
MLP
ALP
DFO
DOB
SS
IS
INS
R1
R2
R3
R4
R5
R6
R7
#1
#2
COM (-)
1IM
2IM
N/C
PLC 100A
CEK
TB37
"0" OPER.
EHS
CCRX
SHG
DFC
UP
ESCO
OUTPUTS
INPUT DESIGNATIONS
ADDRESS
TERMINAL
A0 A1 A2 A3 A4 A5 A6 A7 A8 A9 B0 B1 B2 B3 B4 B5 B6 B7 B8 B9
#1 17 15 13 11 N/C 07 05 03 01 (-) (-) 16 14 12 10 N/C 06 04 02 00
#2 37 35 33 31 N/C 27 25 23 21 (-) (-) 36 34 32 30 N/C 26 24 22 20

FIG. 11

| Input | (0-157) | TABLE I |
|---|---|---|
| 0 | "0"-OPR | |
| 1 | /MLS | Main Landing Sensor |
| 3 | /ALS | Alternate Landing Sensor |
| 4 | EHS | Emer. Hospital Service |
| 5 | HEK | PH.I K/S "ON" Position |
| 7 | HEKB | PH.I K/S "BYPASS" Pos. |
| 10 | CEK | PH.II K/S "ON" Position |
| 11 | HOLD | PH.II K/S "HOLD" Position |
| 13 | RSB | Reset Car Calls Button |
| 14 | CCR (CCRX) | Car Call Registered |
| 15 | RUN | Car Running |
| 16 | HG | Higher Car Call Demand |
| 17 | CSI | Car Stopping Input |
| 21 | DCB | Door Close Button |
| 23 | MLP | Main Landing Position |
| 25 | ALP | Alternate Landing Position |
| 27 | /DFO | Doors Fully Open |
| 30 | /DFC | Doors Fully Closed |
| 31 | DOB | Door Open Button |
| 33 | SS | Safety Shoe |
| 34 | UP | Up Direction Input |
| 35 | IS | Independent Service |
| 36 | MESS | Monitor Em. Stp. Sw. |
| 37 | INS | Inspection Service |
| **Output** | **(200-357)** | **TABLE II** |
| 201 | FSH | Fire Service Hall (PH.I) |
| 203 | RCC | Reset Car Calls |
| 205 | ESCO | Emer. Stop Sw. Cutout |
| 206 | CSR | Car Start Relay Output |
| 207 | FSC | Fire Service Car (PH.II) |
| 210 | PMR | Paw Magnet Reset |
| 211 | FS | Fire Service (PH. I & II) |
| 212 | DC | Door Close |
| 213 | DO | Door Open |
| 214 | /RTML | Return To Main Landing |
| 215 | HCC | Hall Call Cutout |
| 216 | RTAL | Return To Alt. Landing |
| 217 | EBJ | Emergency Buzzer & Jewel |
| 221 | PFI | Power Failure Indicator |
| **Internal relay group 1** | **(400-557)** | **TABLE III** |
| 400 | DIS | Disable System |
| 404 | AL | Alternate Landing |
| 405 | ESL | Emergency Service Landing |
| 406 | ML | Main Land |
| 410 | AOR | Attendent Override |
| 415 | MFSC | Master Fire Serv. Car |
| 420 | DLC | Door Limit Control |
| 425 | PH.I DO | PH.I Door Open Control |
| 430 | PHII DO | PH.II Door Open Control |
| 435 | RML | Remember Main Landing |
| 440 | RAL | Remember Alt. Landing |
| 445 | RE-PH.I | Re-establish PH.I |
| 450 | PRV-RTN | Prevent PH.II Return |

SPECIAL EMERGENCY SERVICE CONTROL ARRANGEMENT FOR ELEVATOR CAR

This is a continuation of application Ser. No. 08/644,938, filed May 13, 1996, now abandoned, which is a continuation of application Ser. No. 08/207,498 filed Mar. 7, 1994, now abandoned.

BACKGROUND OF THE INVENTION

1. Field of the Invention

The present invention relates to electronic control arrangements for an elevator car and, more particularly, to such an arrangement for controlling a car door during an emergency such as a fire.

2. Description of the Prior Art

Known emergency service arrangements which control operation of an elevator car door during a fire emergency are typically located in the operational controller cabinet and electronically interconnected to the door operator by electrical conductors such as twisted wire pairs. The known arrangements include, for example, door control circuits and various sensors in the car and at the landings, which provide various known signals to the operational (main) controller. In known arrangements, the present inventors believe that the main operational controller operationally interacts with the other known circuits to control the car and car door(s) during the emergency. Table 1 of FIG. 11 lists known signals (e.g., EHS, RSB, CCR, RUN, HG, CSI, DCB, DFO, DFC, DOB, SS, UP, IS, MESS, INS) generated according to prior art emergency service arrangements. Such prior art emergency arrangements are often present in known elevator systems employing, main operational controllers.

Firefighters service for automatic elevators is dictated by ASME rules such as 211.3a (Phase I Emergency Recall Operation), 211.3b (Smoke Detectors), and 211.3c (Phase II Emergency In-Car Operation). Essentially, Phase I service is initiated by electrical signals generated externally of the elevator car, while Phase II emergency service is initiated by electrical signals generated internally of the car.

Known controller arrangements for special emergency service appear not to be entirely satisfactory.

The present inventors believe that: a part of the known arrangement, a wire wrapped relay panel (not shown), is field labor intensive to install; the elevator operational (main) controller must interact both on normal service and on special emergency service with the relay panel, thus resulting in a hybrid operation; and, for different code requirements, a different version of the relay panel must be wired.

It is a principal object of the present invention to overcome the drawbacks of the prior art.

It is an additional object of the present invention to provide a versatile and easily implementable electronic control arrangement for special emergency service.

According to the present invention, a special emergency service (S.E.S.) controller arrangement for an elevator car includes: a main controller; an auxiliary controller connected to the main controller, the auxiliary controller including an electronic processor coupled to a memory;

a door operator;

a switch connected to the main controller, to the auxiliary controller and to the door operator; and instructions for sensing a Phase I input signal and for generating an output signal for causing the switch to disconnect the main controller from and to connect the auxiliary controller to the door operator, the instructions being stored within the memory of said auxiliary controller.

Further and still other objects of the present invention will become more readily apparent in light of the following detailed description of a preferred embodiment and best mode when taken in conjunction with the accompanying drawing, in which:

BRIEF DESCRIPTION OF THE DRAWING

FIG. 11 shows tables of input signals (Table 1) output signals (Table 2) and internal signals (Table 3) utilized by the present invention;

DESCRIPTION OF THE PREFERRED EMBODIMENTS AND BEST MODE

The S.E.S. mini-overlay unit 100 (FIG. 1) according to the invention is a stand-alone, microprocessor based (via a Programmable Logic Controller or PLC 100A), separate auxiliary operational controller which will only be active when S.E.S. is initiated by sensing an appropriate Phase I input signal HEK, HEKB, MLS, ALS, or Phase II input signal CEK, HOLD. Regardless of the mode of operation of the elevator (i.e. inspection service, independent service, . . . ), the S.E.S. mini-overlay unit 100 monitors all pertinent information (i.e. door status, car position, . . . ) through input interface relays. The purpose of the relays is to ensure correct voltage levels remain on the controller 100A.

Figure 2:
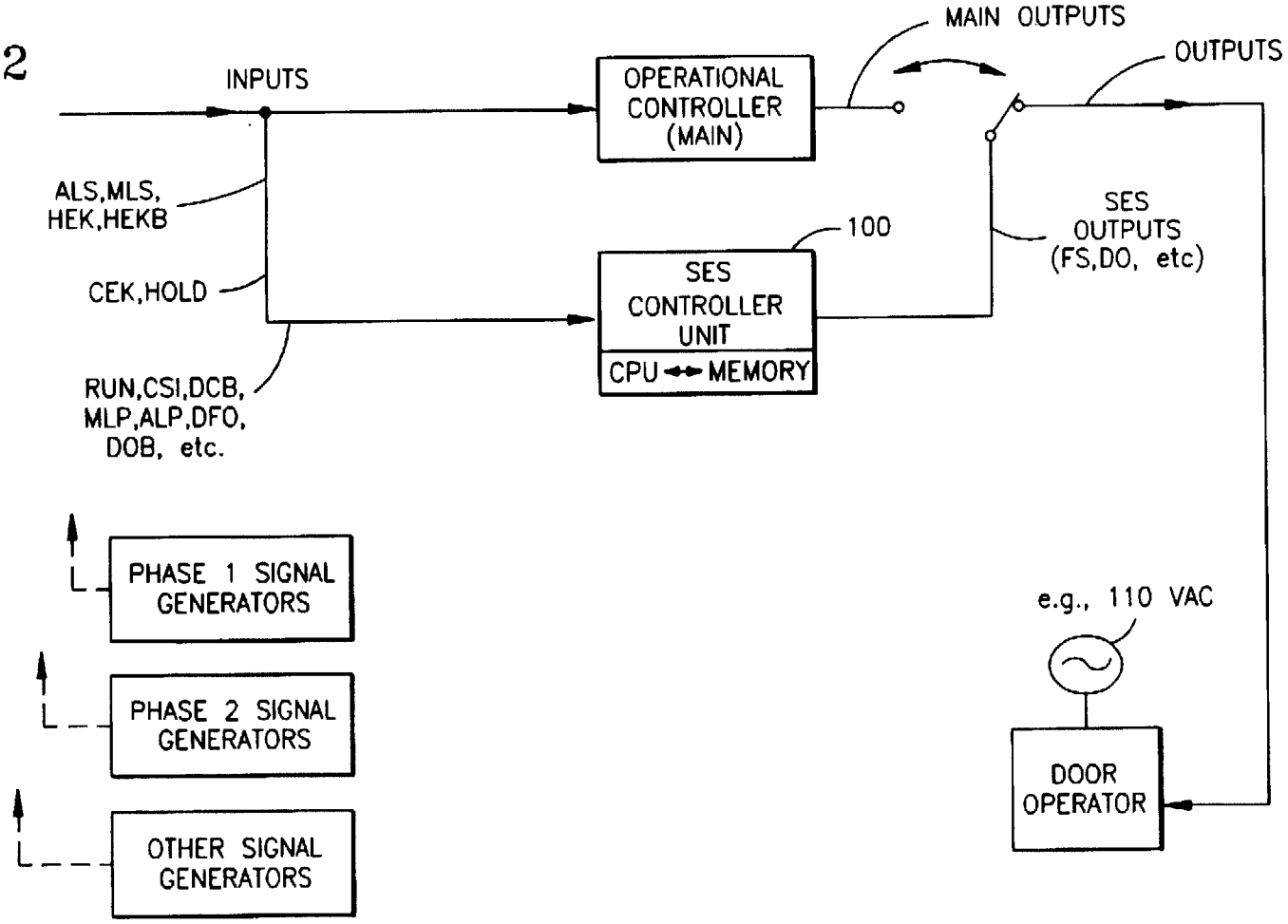
FIG. 2 is a schematic block diagram of a preferred arrangement according to the present invention.
Figures 3, 3A, 3B:
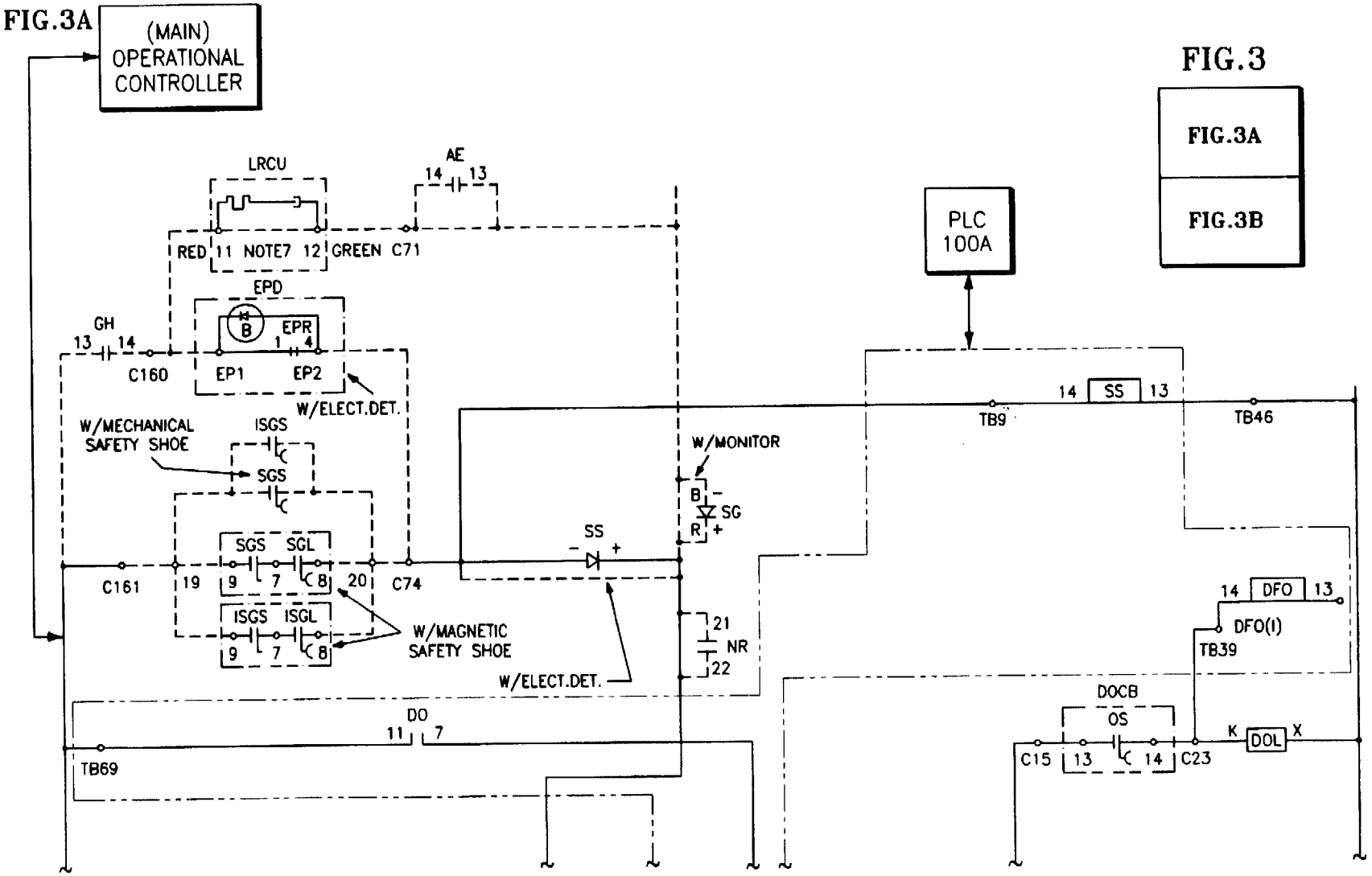
FIG. 3, 3A and 3B are a schematic is a schematic circuit diagram of a portion of the preferred embodiment of the present invention and various signal generators.
Figure 3B:
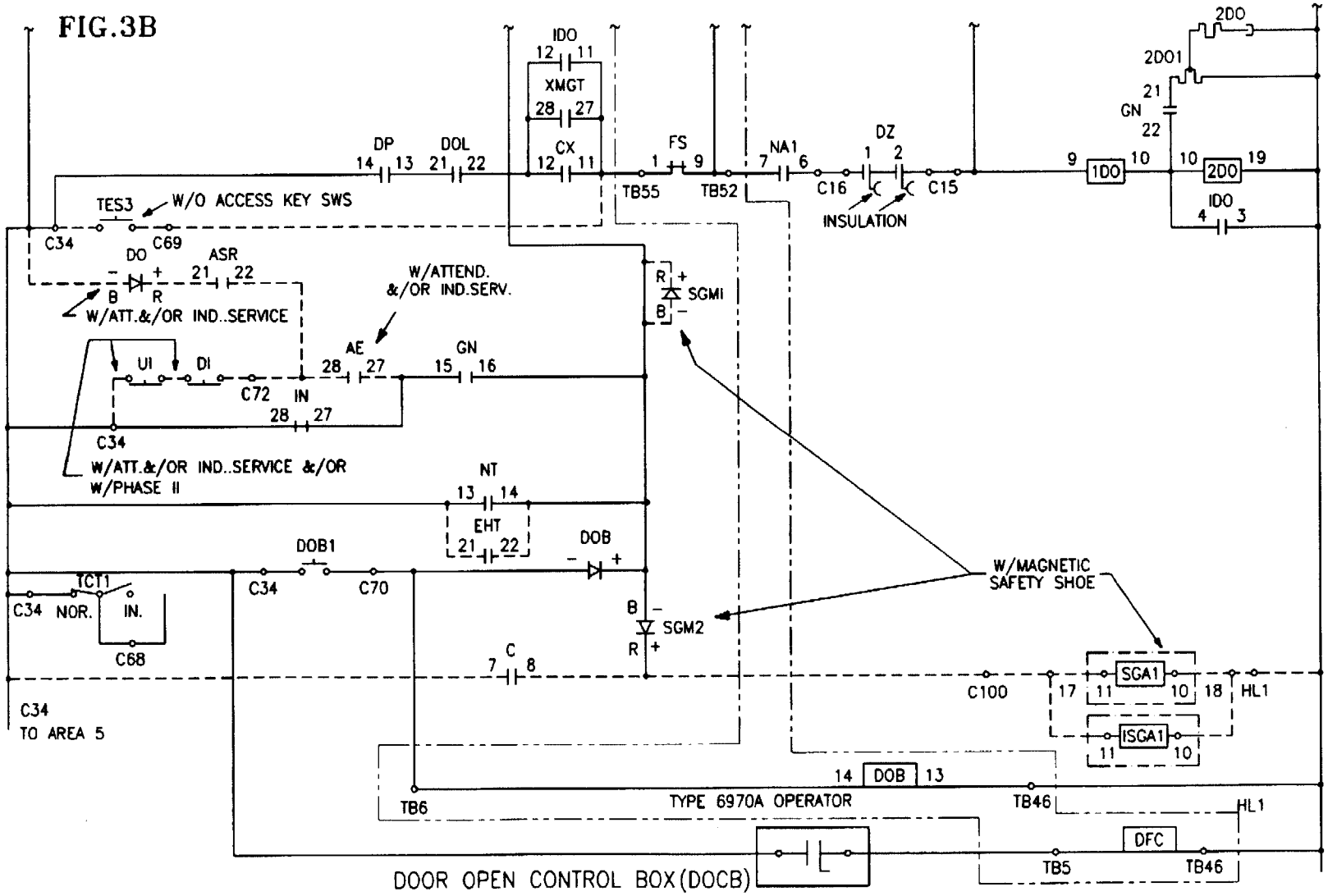

Once S.E.S. has been initiated, the S.E.S. mini-overlay 100 detaches the existing (normal) operational controller from the elevator system and takes over as the primary operational controller. (See FIG. 2.) During this period, all operational functions (door control, enabling car calls, . . . ) are controlled by the S.E.S. mini-overlay through its software (e.g., FIGS. 9 and 10) until the necessary input signals such as HBEK=1 or (MLS=1 and ALS=1) are sent to the unit 100 to return the elevator to normal service.

The detachment/attachment is accomplished via the FS relay (or switch) which is opened (FS=0) when S.E.S. is initiated by the PLC or closed (FS=1) when S.E.S. is terminated by the PLC 100A.

Figure 1:
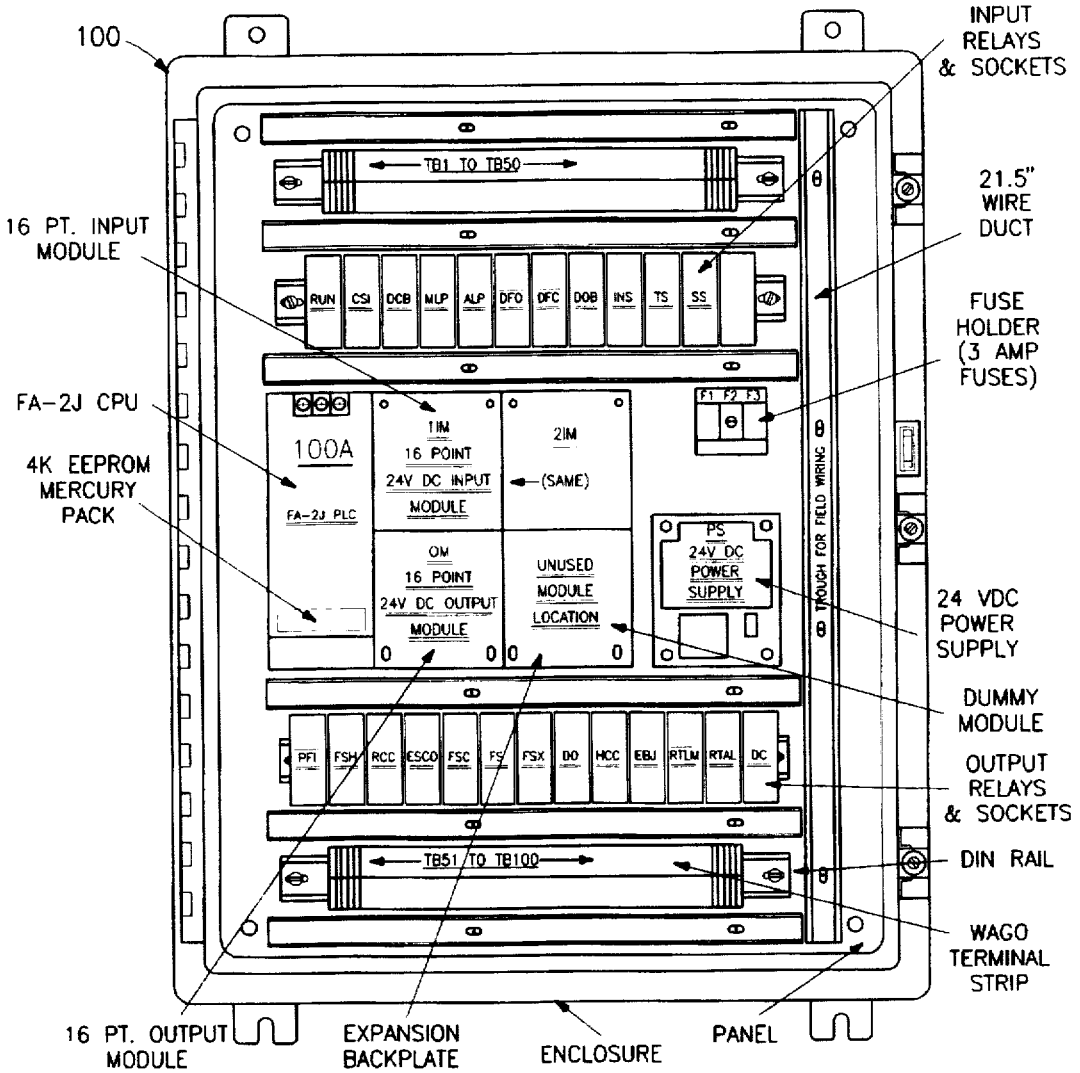
FIG. 1 shows a top planar view and a side view of an auxiliary controller 100 according to the present invention.
Figure 4:
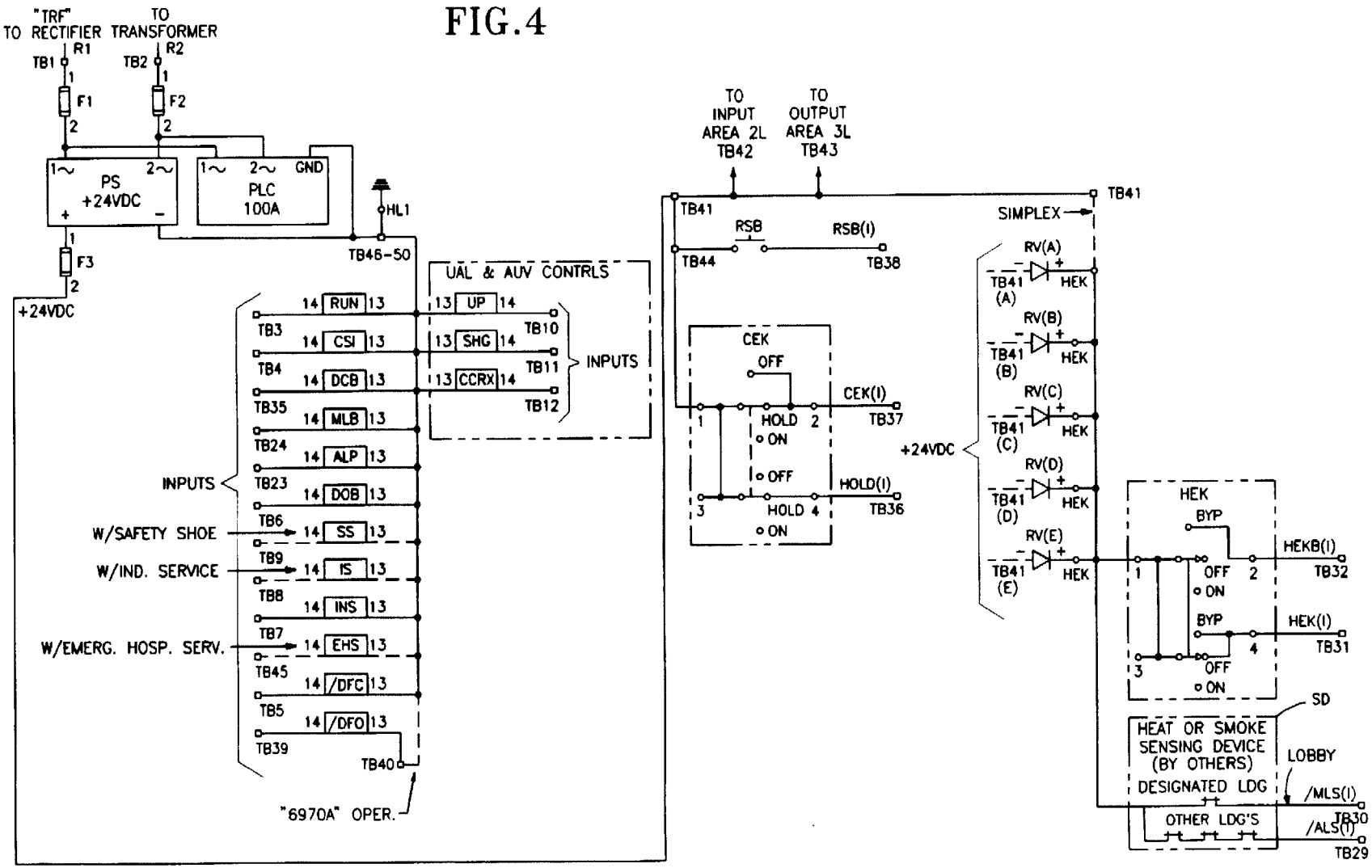
FIG. 4 and FIG. 5, 5A, 5B and 5C show schematic circuit diagrams of one preferred embodiment of the auxiliary controller connected to hall key arrangement HEK (e.g., located at lobby), to car key arrangement CEK (located in each car), and to sensing device arrangements SD.
Figures 5, 5A, 5B, 5C:
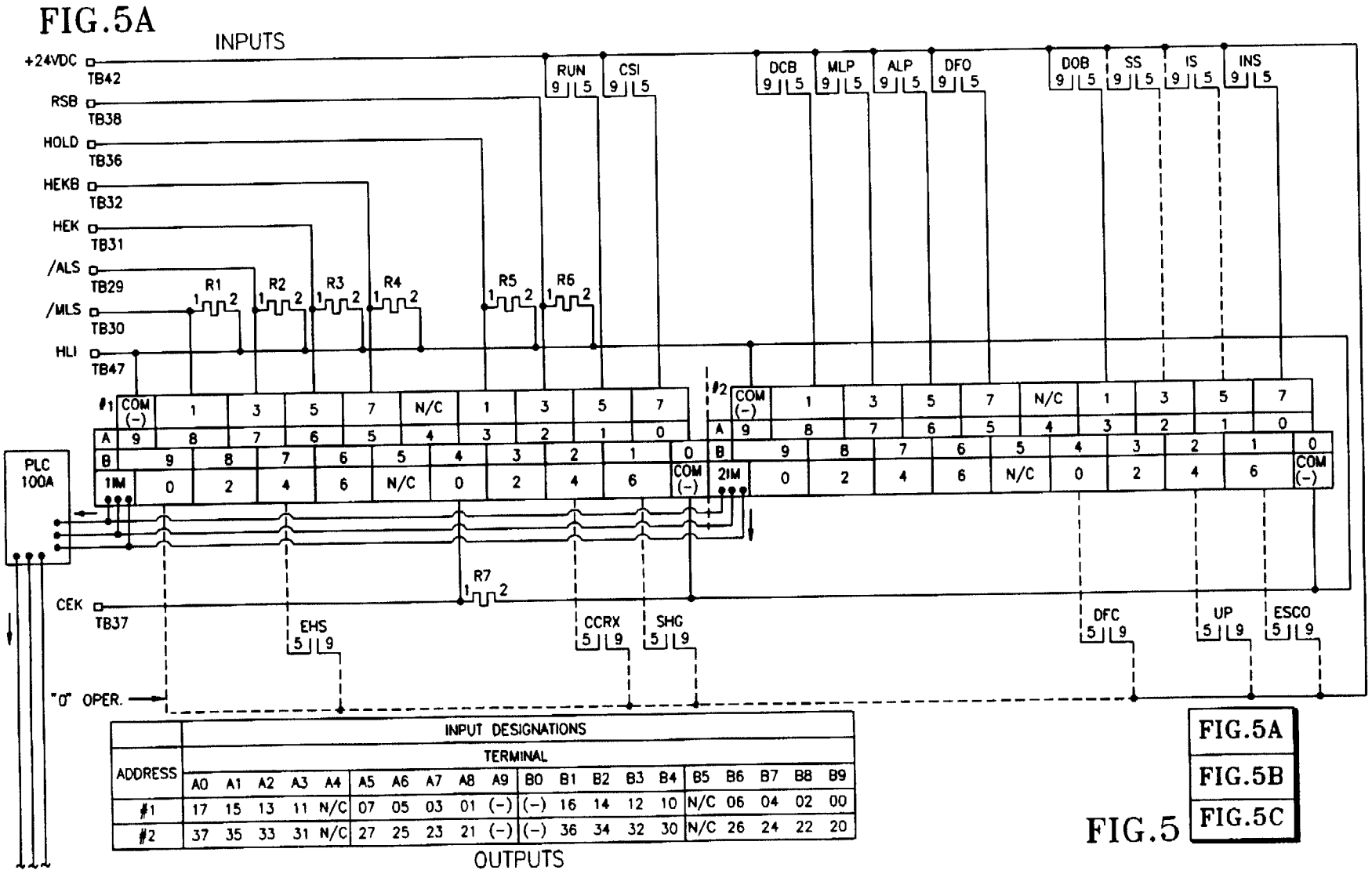
Figure 5B:
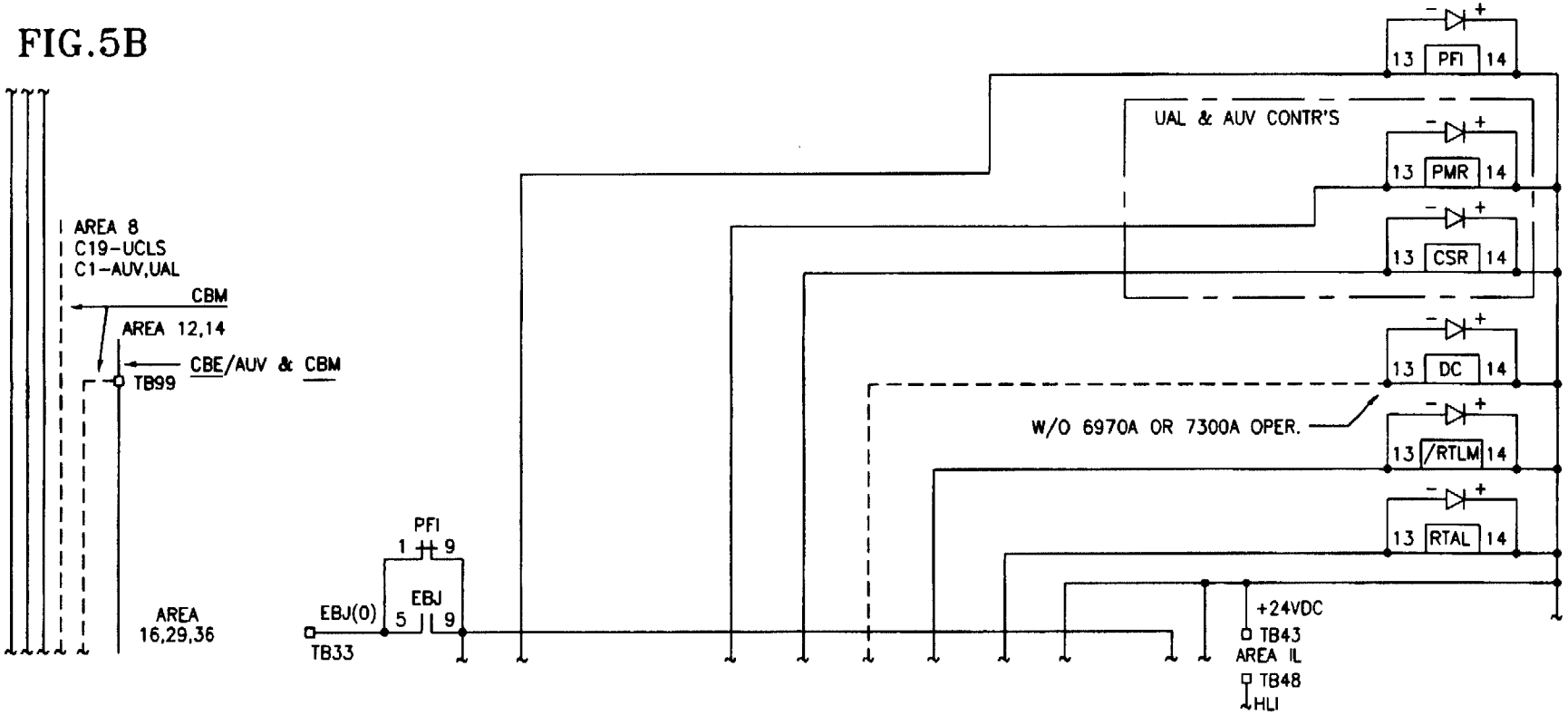
Figure 5C:
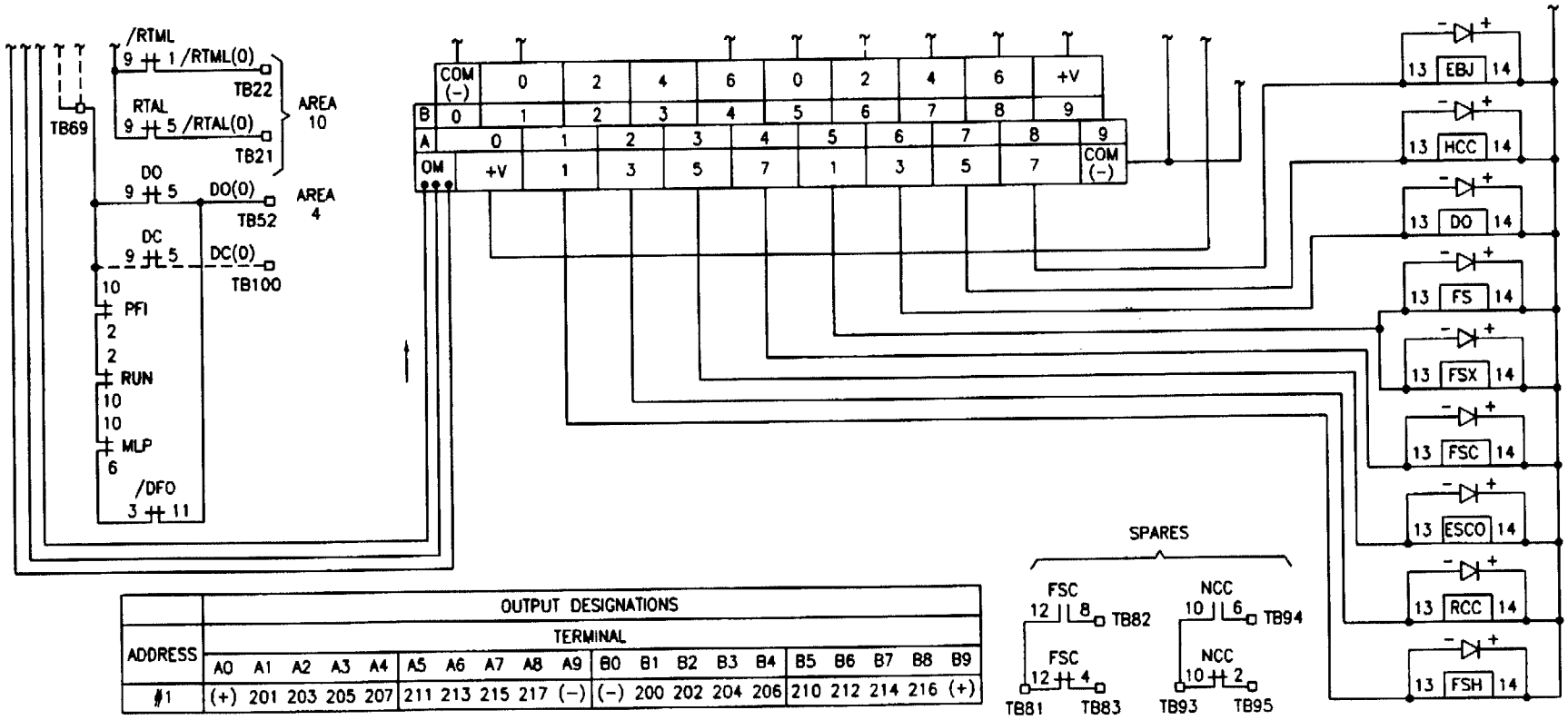
Figure 6:
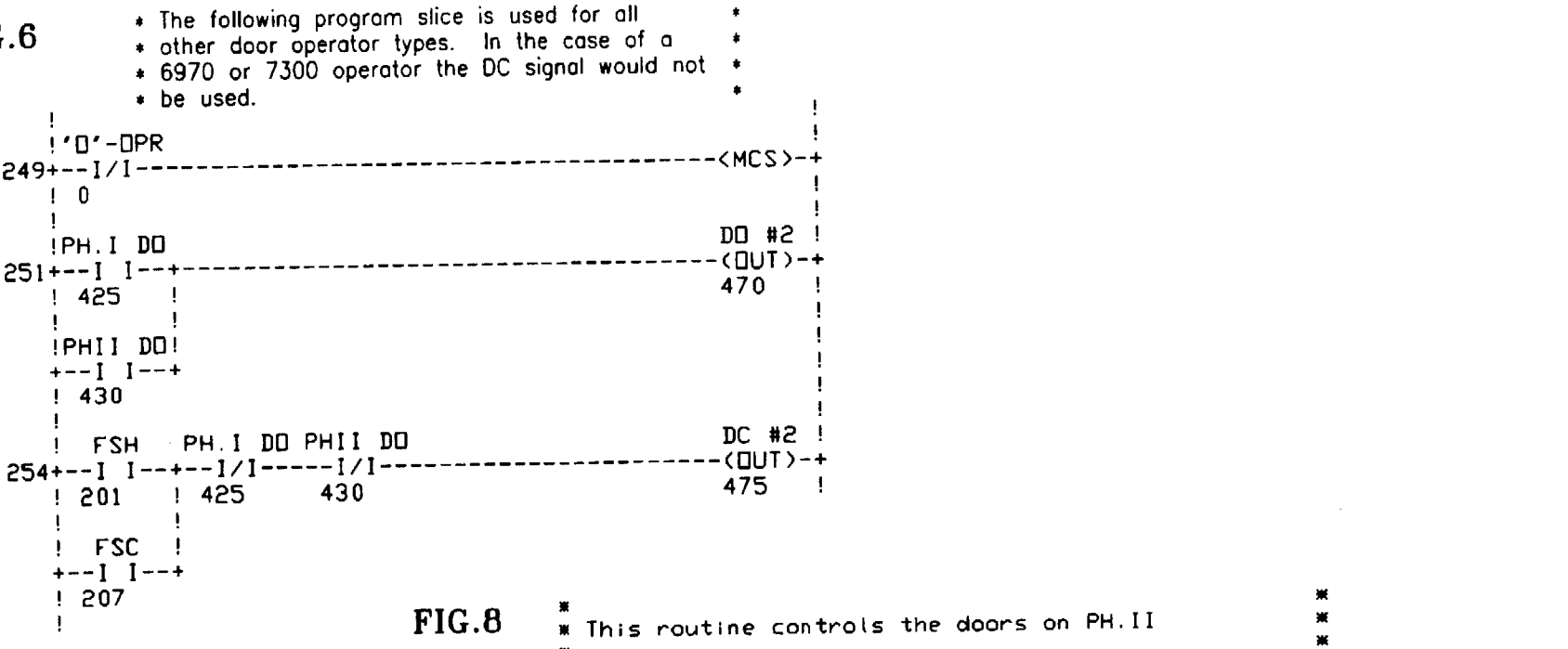
FIG. 6 is a ladder logic diagram showing the relationship between door open signal DO and PH1DO and PH2DO, among other relationships.

The unit 100 includes an electronic processor (e.g. PLC100A), input and output modules, DC power supply, terminal strips, input and output relays, all suitably interconnected as shown in FIGS. 1, 4, and 5. The PLC includes a microprocessor coupled via buses to a memory in which the software routines of the invention are stored.

Upon activation of the S.E.S. unit 100, either through the Phase I separate signals (HEK or HEKB) or a smoke sensor signal (/MLS or /ALS), the output relays (FIG. 5, area 3L) pass control signals to the elevator system. Relays FS and FSX (Fire Service Phase 1) and HCC (Hall Call Cutout) are energized (i.e., are high) during the entire operation. Relay FSH (Fire Service Hall) is energized only during Phase I. Relay FSC (Fire Service Car) is energized only during Phase II. The RCC (Reset Car Calls) relay is energized continuously on Phase I and whenever the car stops or the Call Cancel Button is pressed on Phase II. Relay EBJ (Emergency Buzzer and Jewel) is energized until the car is parked at the emergency return landing which is dictated by input relays MLP (Main Landing Position) or ALP (Alternate Landing Position) being high. The /RTML (active low, Return To Main Landing) and RTAL (Return to Alternate Landing) relays dictate the landing to which the car must return.

Only an /MLS (active low, Main Landing Sensor) input can trigger the RTAL output. The active low status of the /MLS and /ALS (Alternate Landing Sensor) inputs is to ensures an S.E.S. activation in the event of a smoke sensor (SD) failure. The active low status of /RTML and /PFI (Power Failure Indication) is part of a fail safe routine shown in FIGS. 10 and 17 which will sound a buzzer (not shown) and return the car to the main landing in the event of a power supply failure or a software failure. The ESCO (Emergency Stop Switch Cutout) relay electrically disables the emergency stop switch once the car has started to run on Phase I. An ESCO contact is also used as an input to monitor a welded contact condition. The DO (Door Open) and DC (Door Close) relays are used for door control at all times while on S.E.S. The PMR (Pawl Magnet Reset) relay is used to force a stop on Phase I and when the Call Cancel Button is pressed on Phase II. The CSR (Car Start) relay is used to dictate whether or not the car can start CSR=high.

Figure 8:
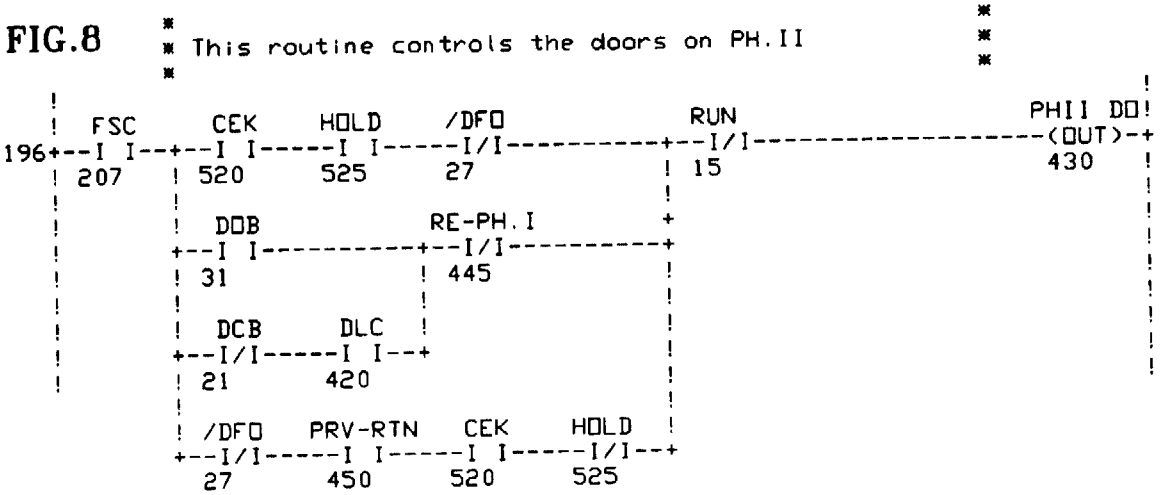
FIG. 8 is a ladder logic diagram of a Phase II DO routine according to the present invention.
Figure 7:
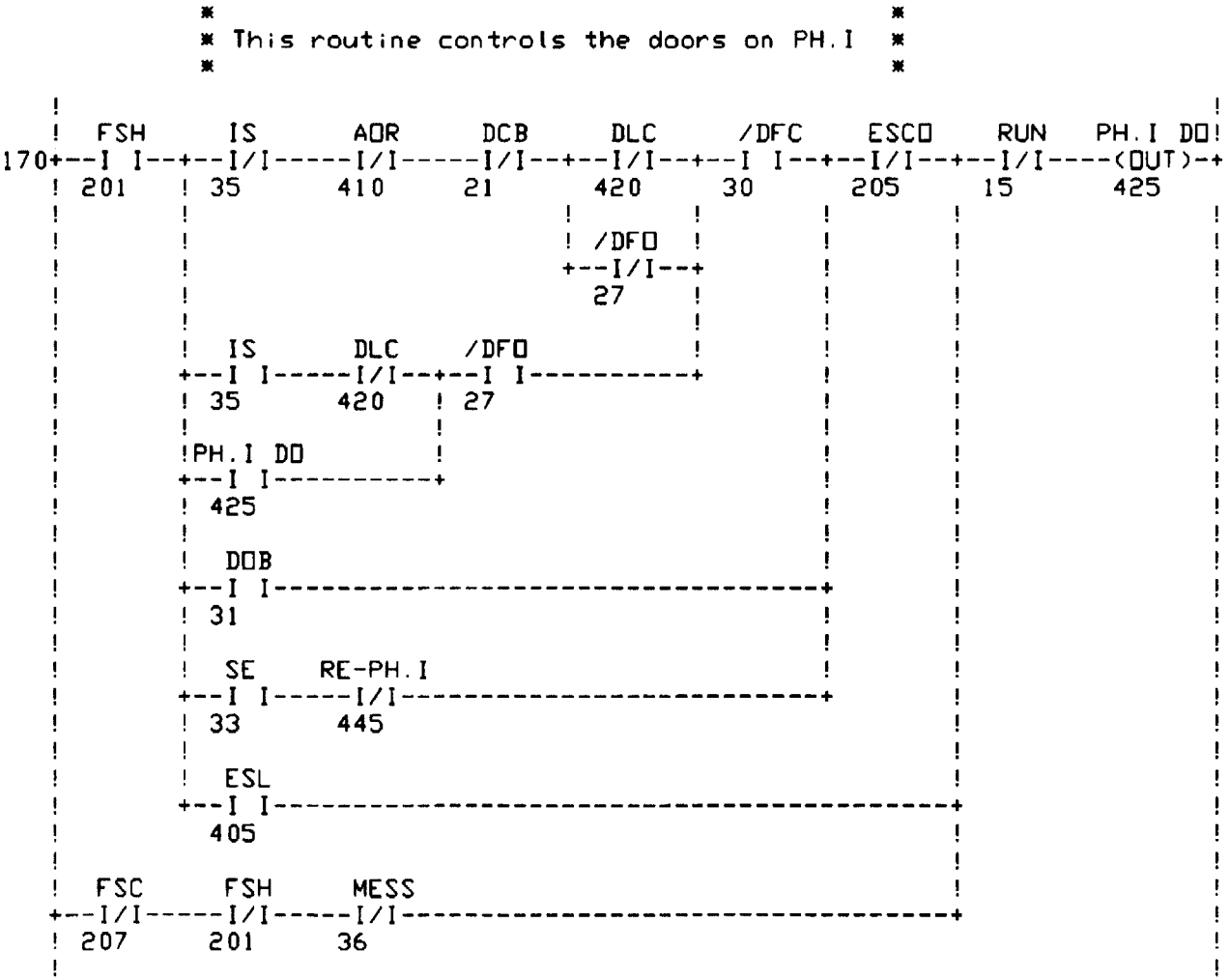
FIG. 7 is a ladder logic diagram of a Phase I DO routine according to the present invention.
Figure 9:
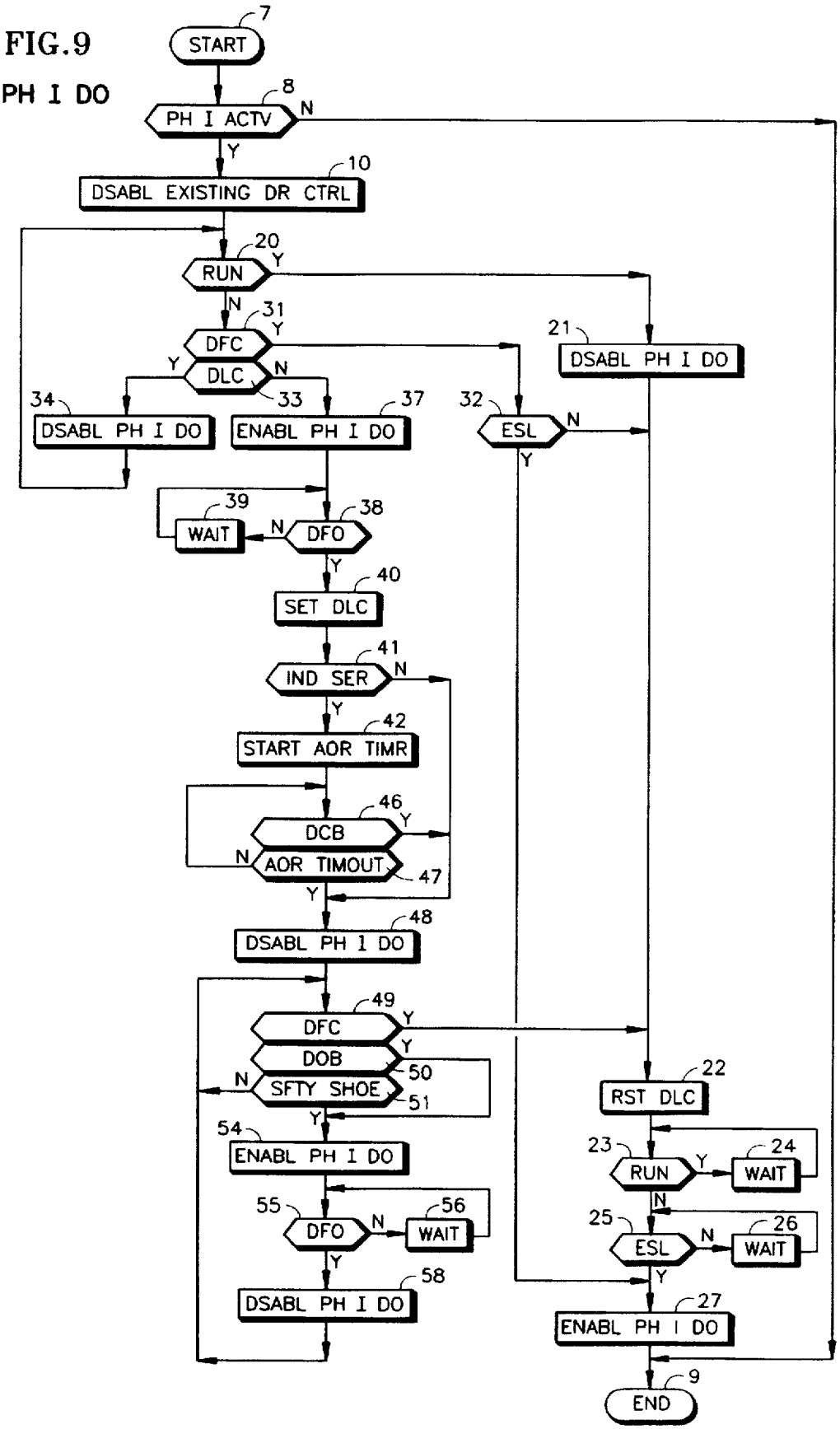
FIG. 9 are high level logic flow diagrams explaining the operation of the routine of FIG. 7.

The mini-overlay door control circuits (FIGS. 2–10) of the invention are designed so that there is no need to have the fire service system (100) interact with the elevator main controller during special emergency service. Under this new system of the invention, when fire service is initiated, the control of the doors is driven solely by the mini-overlay unit 100. A fire service breaking contact (FS) disables the existing door controls and the elevator main controller from the DO relay. The DO relay is then controlled solely by the DO output on the mini-overlay 100. This output DO is driven by two separate means: a Phase I door control signal (PH. I DO) and a Phase II door control signal (PH. II DO). PH. I DO is generated according to the routines of FIGS. 7 and 9. PH. II DO is generated according to the routines of FIGS. 8 and 10. In FIG. 9A, the step 10 is accomplished by opening the FS relay (FS=0). Step 20 is ascertained by examining RUN input signal. The elevator is running if RUN=1. RUN is conventionally generated from the elevator drive system (e.g., motor or position transducers etc.).

The PH. I DO signal shown in FIG. 7 monitors all the input signals (DOB, SS and ESL, etc.) necessary for door control on Phase I. It also interprets the door position status by monitoring DFO and DFC and it creates a door transitional signal (DLC). DFO and DFC are known signals generated by conventional sensors located on the car. DLC is low when doors are fully open and stays low until the doors are fully closed. Then, DLC goes high. DLC is determined by software in the PLC. From all this information (signals), the mini-overlay 100 dictates the Phase I control of the doors.

The PH. II DO signal shown in FIG. 8, monitors the Phase II keyswitch position (CEK and HOLD), DOB, DCB and the door position information (DFO, DFC and DLC). From this information, the mini-overlay dictates the Phase II control of the doors.

Referring to FIG. 9, a phase one door open return is reached through a start point 8 and a first test 9 determines if phase one is active or not depending upon whether the fireman key switch or smoke or other sensor signal has been detected. If phase one is not active, a negative result of test 8 reaches an end point 9 and no action is taken. But if phase one is active, then a step 10 will disable the existing door control in the normal, operational controller of the elevator system. This is an important aspect of the present invention. Then a test 20 determines if the elevator is running or not. If the elevator is running, the motion control circuits thereof will have ordered it to an emergency service landing. An affirmative result of test 20 reaches a step 21 which disables the phase one door open command, and then a step 22 resets the door limit control. A test 23 along with a step 24 causes a continuous monitoring of the run condition until the completion of the run. When the run is completed, a test 25 and step 26 cause the routine to wait until the emergency service landing signal appears. Once that happens, a step 27 will enable phase 1 door open, thereby opening the door for access by firemen or other emergency personnel, and the program is ended at the point 9.

On the other hand, if the elevator is not running, a negative result of test 20 will reach a test 31 to see if the door is fully closed. If it is, a test 32 determines if the emergency service landing signal is present as yet, or not. If it is, the result is the same as an affirmative result of test 25: the step 27 causes the door to open and the routine is ended. If the emergency service landing signal has not yet appeared, a negative result of test 32 reaches the step 22 to reset the door limit control, and then wait, however long it takes, for the elevator to be operated to reach the emergency service landing, in a manner described with respect to tests and steps 23–26, hereinbefore. And then the door is opened in step 27.

But if the elevator is not running and the door is not fully closed, then a test 33 determines if the door is open or closing, as indicated by the presence of the door limit control. If, when phase one becomes active, the door is either open or in the process of closing, an affirmative result of test 33 reaches a step 34 to ensure that there is no door open signal. Thereafter, the tests 31 and 33 are again reached, and this process will continue until the door becomes fully closed. Thereafter, operation will pass through the step 32 as described hereinbefore.

But if the doors are neither closed, open, nor closing, then they must be opening; an attendant may be inside. Therefore, a negative result of test 33 reaches a step 37 to enable phase one door open. Then a test 38 and a step 39 monitor the condition of the door until it is fully open, after which the door limit control is set in a step 40. A test 41 determines if the car is on independent service. Therefore, an affirmative result of test 41 reaches a step 42 to start an attendant override (AOR) timer, to give the attendant a chance to close the door if that is the attendant's intent. Then a test 46 determines if the door close button has been operated or not. If not, a test 47 determines if the attendant override timer has timed out yet or not. If not, these two tests are repeated. But should either the door close button be pressed as indicated by an affirmative result of test 46 or the attendant override timer time out, as indicated by an affirmative result of test 47, then the phase one door open is disabled in a test 48 to close the door. Then a conventional series of tests 49–51 continue to monitor the door open button and the safety shoe until the door becomes fully closed. If, after the phase one door open is disabled in step 48 either the door open button (test 50) or a safety shoe signal (test 51) occurs prior to the door fully closing, then a step 54 will enable phase one door open, and a step and test 55, 56 will monitor the door condition until it is fully open. Once the door is fully open, an affirmative result of test 55 reaches a step 58 to disable the phase one door open. Then the steps 49–58 are repeated; eventually, there will be no signal from the door open button or a safety shoe so that a negative result of tests 50 and 51 will reach the test 49. Eventually, the door is fully closed so an affirmative result of test 49 reaches the step 22 et seq. for operation as described hereinbefore.

Figure 10:
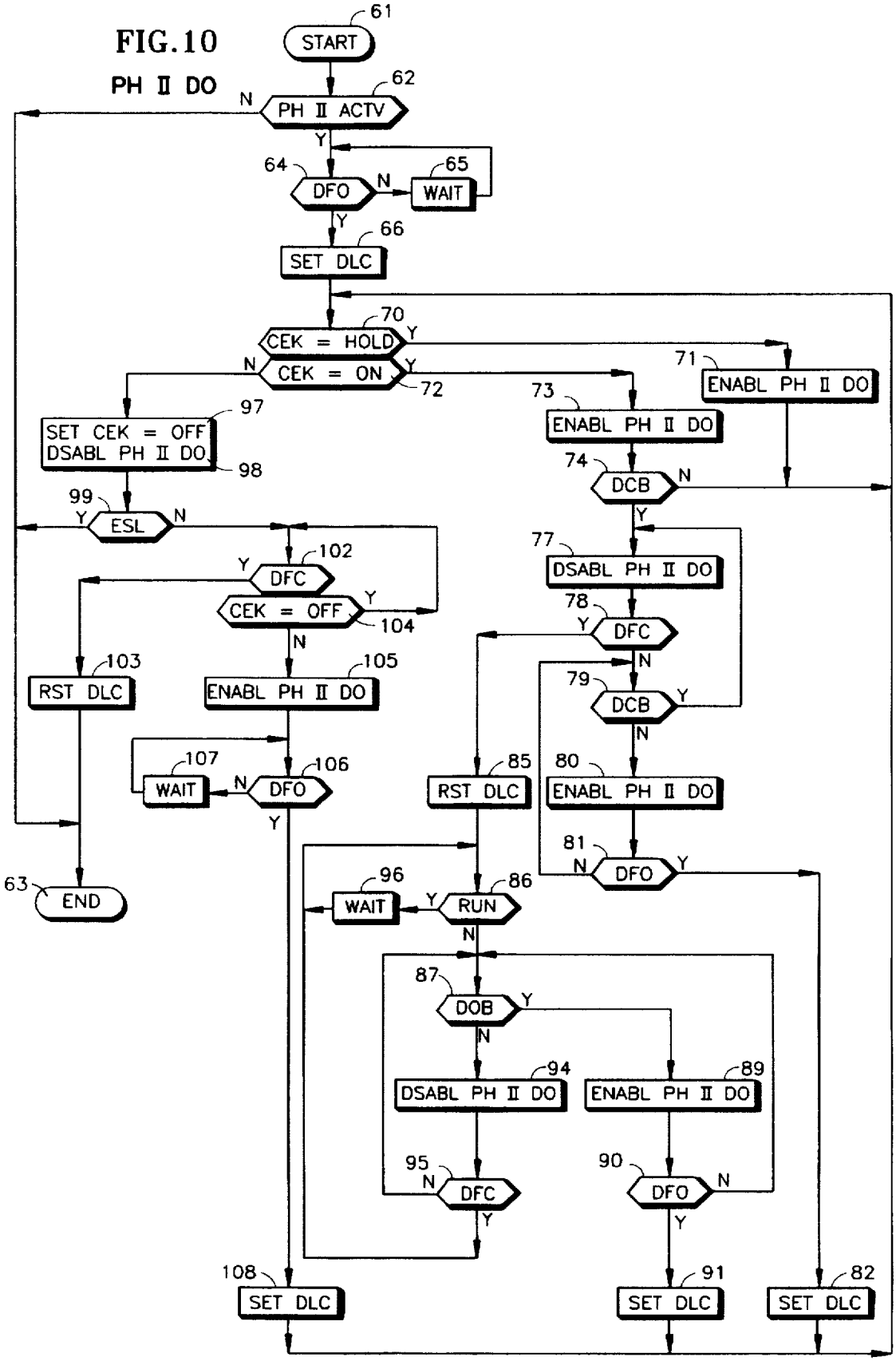
FIG. 10 are high level logic flow diagrams explaining the operation of the logic diagram of FIG. 8.

The phase two door open routine in FIG. 10 is reached through a start point 61 and a first test determines if phase two is active (as determined by a fireman key switch inside the car), or not. If not, no action is taken and the routine ends through a point 63. If phase two is active, the door should be fully opened, but it may not yet be. Therefore, a test 64 and a step 65 monitor the door condition until the door is fully open. Once the door is open, the door logic control signal is set in a step 66.

A test 70 determines if the car emergency key switch is set on hold. If it is, this means the fireman wants to hold the car where it is with the door open, which is accomplished in a step 71. But, when the key switch is turned to on, a negative result of test 70 reaches a test 72 which, when the key switch is on, will reach a step 73 to ensure the door is open. Then, a test 74 determines if the door close button has been pressed or not. If not, the routine again cycles through the tests 70 and 72 holding the door open in step 73. Eventually, the fireman will likely press the door close button so an affirmative result of test 74 will reach a step 77 to disable phase two door open, thereby closing the door. Therefore, a test 78 determines if the door is fully closed, and until it is, a test 79 determines if the door close button is still being pressed. If the door close button is still being pressed, the routine cycles through the step and tests 77–79 until the doors finally close. If the door close button is not continuously pressed until the door is fully closed, a negative result of test 79 will reach a step 80 to enable phase two door open, and a test 81 determines if the door is fully open or not. Until the door is fully open, the routine cycles through the door close button test 79. But once the door is fully opened, an affirmative result of test 81 will set the door logic control in a step 82, and then the routine reverts back to the tests 70, 72.

On the other hand, if test 78 indicates that the door has become fully closed, a step 85 will reset the door logic control and a test 86 determines if the motion controller has caused the elevator to run, or not. A negative result of test 86 will reach a test 87. If the door open button has been pressed, a step 89 will enable phase two door open, and a test 90 will determine if the door is fully open or not. Initially, it would not be, so the routine will cycle through the tests and step 87–90 until the doors fully open. Then a step 91 will set the door logic control signal and the program will revert to the tests 70 and 72 one more time. In the usual situation as emergency personnel wait for the elevator to run, the door open button will not have been pressed so test 87 will be negative disabling phase two door open in a step 94. Then the test 95 re-affirms that the door is fully closed; because the door open button could have been pressed for a period of time less than that required to get the door fully open. In such a case, test 90 would have been negative and test 87 negative. If the door is not fully closed, the routine cycles through the test 87, step 94 and test 95 until the door again becomes closed. A negative result of test 86 and test 87 along with an affirmative result of test 95 will revert to test 86, until the elevator begins to run.

Throughout the entire run of the elevator, the routine of FIG. 10 will loop through test 96 waiting for the elevator to complete its run. At the end of the run, a negative result of test 86 will reach test 87 waiting for emergency personnel to press the door open button. Until the door open button is pressed, the routine cycles through negative results of tests 86 and 87, and an affirmative result of test 95. Once the door open button is pressed, the step 89 will enable phase two door open, and the routine will cycle through a negative result of test 90 and an affirmative result of test 87 until the door is fully open. If emergency personnel release the door open button before the door is fully opened, then the door will again be closed by virtue of step 94 and test 95. An affirmative result of test 90 will set the door logic control signal in step 91 and the routine will revert to tests 70 and 72.

When emergency personnel are ready to leave the car, the car emergency key is turned from on to off. This will cause a negative result of test 72 to reach a pair of steps 97 and 98 to set the CEK signal to off, and to disable phase two door open, so the door will commence to close. Then a test 99 determines if the car is at the emergency service landing. If it is, the routine ends at point 63. If the car is not at the emergency service landing, then the emergency service may not be over as yet, even though the car emergency key has been turned off. For that reason, a negative result of test 99 will reach a test 102 to determine if the door is fully closed, or not. An affirmative result of test 102 reaches a step 103 to reset the door logic control, and the routine is ended at point 63. Until the door is fully closed, however, a negative result of test 102 reaches a test 104 to see if the key still is off. Should the car emergency key be turned on during the time that the door is closing, then a negative result of test 104 will reach a step 105 to enable phase two door open. If the key is turned back on and step 105 performed, a test 106 and a step 107 monitor the door condition until the door becomes fully opened. When the door is fully opened, the door logic control is set in a step 108 and programming reverts to the tests 70 and 72 to determine what emergency service personnel wish to do now.

Finally, coding or otherwise implementing the present invention is well within the skill of the art in view of the instant disclosure.

While there has been shown and described what is at present considered the preferred embodiments of the present invention, those skilled in the art will understand that various changes and modifications may be made therein without departing from the spirit and scope of the invention as defined by the appended claims.

What is claimed is:

1. A controller arrangement for an elevator car, comprising:

a main controller;

an auxiliary controller connected with said main controller, said auxiliary controller including a CPU coupled to a memory;

a door operator;

a switch connected to said main controller, to said auxiliary controller and to said door operator;

instructions for sensing a Phase I input signal and for generating an output signal for causing said switch to disconnect said main controller from and to connect said auxiliary controller to said door operator, said instructions being stored within said memory of said auxiliary controller; and a detector for detecting an atmospheric condition and for generating said Phase I signal, said detector being connected to an input of said auxiliary controller said detector being located externally of an elevator car.

2. An arrangement as claimed in claim 1, wherein said detector is a smoke detector.

3. An arrangement as claimed in claim 1, wherein said detector is a heat detector.

4. An arrangement as claimed in claim 1, further including a key switch for generating said Phase I signal.

5. A controller arrangement for an elevator car, comprising:

a main controller;

an auxiliary controller connected with said main controller, said auxiliary controller including a CPU coupled to a memory;

a door operator;

door control buttons in said car for controlling said door operator;

an emergency service car key switch disposed in said car;

a transfer switch connected to said main controller, to said auxiliary controller and to said door operator;

a detector for detecting an atmospheric condition and for generating a Phase I emergency service signal, said detector being connected to an input of said auxiliary controller, said detector being located externally of an elevator car;

a key switch for generating said Phase I emergency signal;

instructions within said memory of said auxiliary controller for sensing said Phase I emergency signal and in response thereto for causing said transfer switch to disconnect said main controller from and to connect said auxiliary controller to said door operator, and for controlling door operation during Phase I emergency service and, in response to said emergency service car key switch and said door control buttons, controlling said door operator during Phase II emergency service.

* * * * *